US008091461B1

(12) United States Patent
Buescher et al.

(10) Patent No.: US 8,091,461 B1
(45) Date of Patent: Jan. 10, 2012

(54) SYSTEM FOR WATER-BASED LAUNCH OF AN UNMANNED AERIAL VEHICLE

(75) Inventors: James G. Buescher, San Diego, CA (US); Christopher D. Mailey, Durham, NC (US); Ryan M. Stenson, Washington, DC (US); Daniel A. Sura, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 573 days.

(21) Appl. No.: 12/336,020

(22) Filed: Dec. 16, 2008

Related U.S. Application Data

(60) Provisional application No. 61/034,032, filed on Mar. 5, 2008.

(51) Int. Cl.
*F41F 3/07* (2006.01)

(52) U.S. Cl. ..... 89/1.81; 89/5; 114/318; 244/63

(58) Field of Classification Search ..... 89/1.809, 89/1.81, 5; 114/316, 317, 318, 319, 321, 114/322, 361; 244/63
See application file for complete search history.

(56) References Cited

U.S. PATENT DOCUMENTS

| | | | | | |
|---|---|---|---|---|---|
| 3,208,346 | A * | 9/1965 | Penza et al. | 89/1.809 |
| 3,245,318 | A * | 4/1966 | Finkelstein et al. | 89/1.809 |
| 3,249,014 | A * | 5/1966 | Daughenbaugh | 89/1.809 |
| 3,279,319 | A * | 10/1966 | Semonian et al. | 89/1.81 |
| 3,340,767 | A * | 9/1967 | Penza | 89/1.809 |
| 3,513,750 | A * | 5/1970 | Penza | 89/1.809 |
| 3,755,836 | A * | 9/1973 | Milazzo | 441/22 |
| 4,383,831 | A * | 5/1983 | Cupolo et al. | 441/22 |
| 5,108,326 | A * | 4/1992 | Seiler | 441/22 |
| 5,615,847 | A * | 4/1997 | Bourlett | 244/63 |
| 5,695,153 | A | 12/1997 | Britton et al. | |
| 6,164,179 | A | 12/2000 | Buffman | |
| 6,286,410 | B1 | 9/2001 | Leibolt | |
| 6,487,952 | B1 * | 12/2002 | Borgwarth et al. | 89/1.81 |
| 6,502,528 | B1 * | 1/2003 | MacLeod et al. | 114/319 |
| 6,530,305 | B1 * | 3/2003 | MacLeod et al. | 89/1.81 |
| 7,032,530 | B1 * | 4/2006 | Ansay et al. | 114/319 |
| 7,226,328 | B1 * | 6/2007 | Puzella et al. | 441/11 |
| 7,243,609 | B1 | 7/2007 | Ansay et al. | |
| 7,472,866 | B2 * | 1/2009 | Heaston et al. | 244/63 |
| 7,779,772 | B2 * | 8/2010 | Wallin | 114/319 |
| 7,946,241 | B2 * | 5/2011 | Sampson et al. | 114/261 |
| 2003/0033926 | A1 * | 2/2003 | MacLeod et al. | 89/1.81 |
| 2009/0107386 | A1 * | 4/2009 | Sampson et al. | 114/261 |
| 2009/0126619 | A1 * | 5/2009 | Woolwright et al. | 114/322 |
| 2010/0000463 | A1 * | 1/2010 | Root, Jr. | 114/316 |
| 2010/0024708 | A1 * | 2/2010 | Wallin | 114/319 |

* cited by examiner

*Primary Examiner* — Benjamin P Lee
(74) *Attorney, Agent, or Firm* — Ryan J. Friedl; Kyle Eppele

(57) ABSTRACT

A system includes a support structure having a compressed air tank therein, a pneumatic launch assembly coupled to the support structure, and an inflatable bladder disposed around at least a portion of a region defined by the support structure and the pneumatic launch assembly. The angle of the pneumatic launch assembly with respect to the support structure is adjustable. The pneumatic launch assembly comprises a launch tube, a compressed air manifold contained within the launch tube and in fluid connection with the compressed air tank, the compressed air manifold having an air outlet, a telescoping guide rod connected to the compressed air manifold, and a shuttle slidably coupled to the telescoping guide rod and at least partially disposed over the air outlet. The system may include a collapsible stabilizing weight coupled to the support structure, as well as communications and control circuitry within the launch tube.

12 Claims, 7 Drawing Sheets

SYSTEM FOR WATER-BASED LAUNCH OF AN UNMANNED AERIAL VEHICLE

CROSS-REFERENCE TO RELATED APPLICATIONS

This application claims the benefit of U.S. Provisional Patent Application Ser. No. 61/034,032, filed Mar. 5, 2008, entitled "System and Method for an Underwater Launched Unmanned Aerial Vehicle," the content of which is fully incorporated by reference herein.

FEDERALLY SPONSORED RESEARCH AND DEVELOPMENT

The System for Water-based Launch of an Unmanned Aerial Vehicle is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case No. 99136.

BACKGROUND

Unmanned aerial vehicles (UAVs) are becoming more prevalent in modern warfare. In addition to land-based launches of UAVs, water-based UAV launches are desirable in many operational scenarios. However, the general instability of the water environment makes successful water-based UAV launches difficult to achieve. As an example, due to wave turbulence, many UAVs are unable to be launched at an angle that allows the UAV to readily transition to flight, resulting in the UAV being lost to the water environment. A need exists for a water-based system that can successfully and reliably launch a UAV.

DETAILED DESCRIPTION OF SOME EMBODIMENTS

Figure 1:
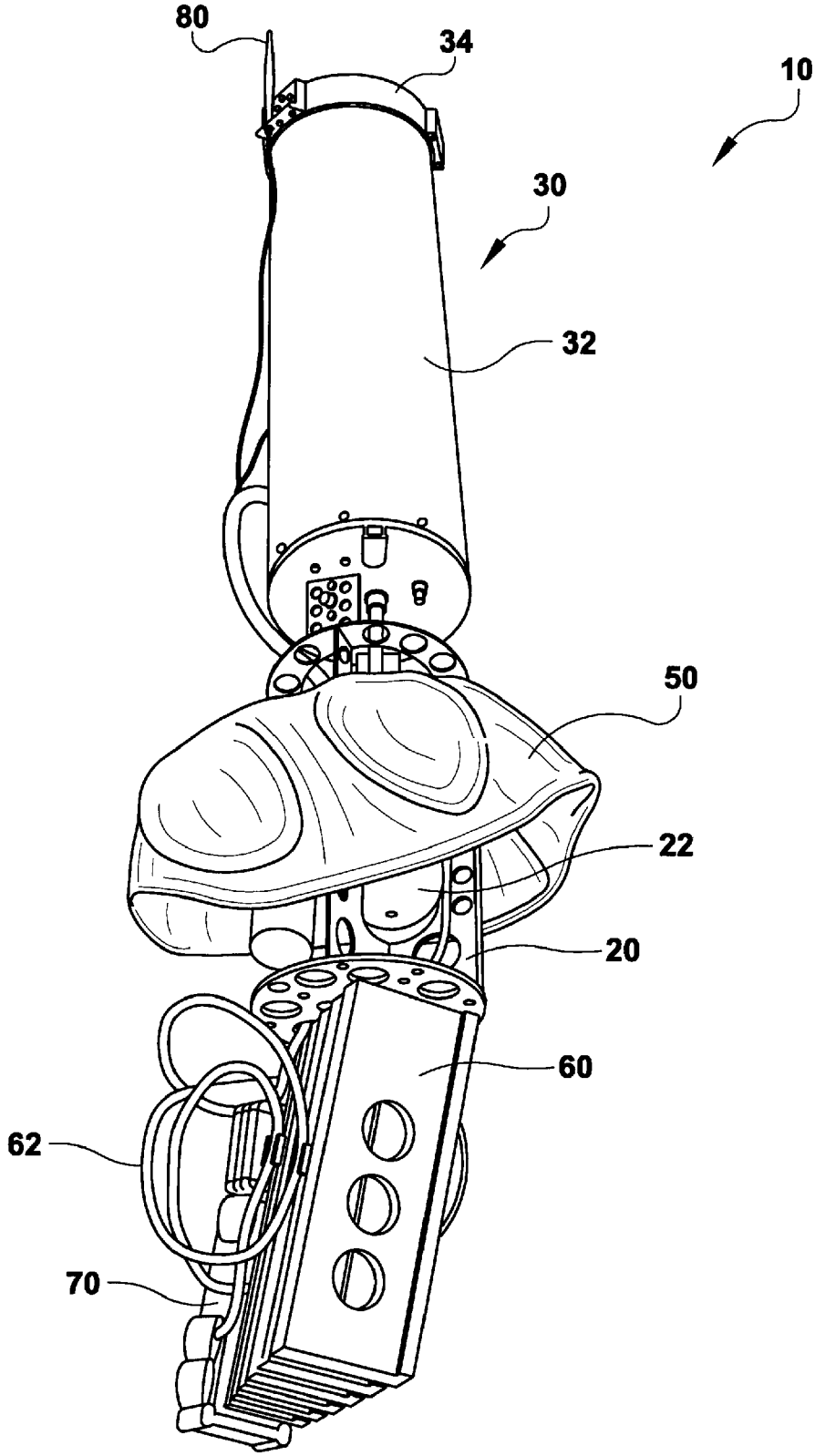
FIG. 1 shows a diagram of an embodiment of a system in accordance with the System and Method for an Underwater Launched Unmanned Aerial Vehicle.

FIG. 1 shows a diagram of a system 10 in accordance with the System and Method for an Underwater Launched Unmanned Aerial Vehicle. System 10 may include a support structure 20, a pneumatic launch assembly 30, an inflatable bladder 50, a collapsible stabilizing weight 60, and a battery pack 70. Support structure 20 may have at least one compressed air tank 22 stored therein. Pneumatic launch assembly 30 may be coupled to one end of support structure 20, such that the angle of pneumatic launch assembly 30 with respect to support structure 20 is adjustable to various angles. As launch angle is critical to a launched UAV's successful transition to flight, an adjustable launch angle configuration allows launching of several different airframe platforms under different environment conditions caused by factors such as wind speed, wind direction, sea state, etc.

Pneumatic launch assembly 30 may include a launch tube 32 and a cap retaining ring 34 connected thereto. Cap retaining ring 34 secures a cap (not shown) to launch tube 32. In other embodiments, the cap may be pressure fit within launch tube 32 or hingedly connected to launch tube 32. Inflatable bladder 50 may be disposed around at least a portion of a region defined by support structure 20 and pneumatic launch assembly 30. A collapsible stabilizing weight 60 may be coupled to the other end of support structure 20. Battery pack 70 may be coupled to stabilizing weight 60. An electrical cable 62 may be connected to battery pack 70. Cable 62 may run through support structure 20 and connect to communications and control circuitry contained within launch tube 32, such as communications and control circuitry 270 shown in system 200 of FIG. 3.

System 10 may further include an antenna 80, which may be connected to communications circuitry contained within launch tube 32. The placement of antenna 80 within system 10 may vary. For example, antenna 80 may be coupled to launch tube 32 or support 20 structure 20. Antenna 80 allows communications from a UAV 100 (see FIG. 2) to be received by system 10. System 10 may then transmit the communications back to a submerged vehicle via fiber-optic cable 90 (see FIG. 2).

Figure 2:
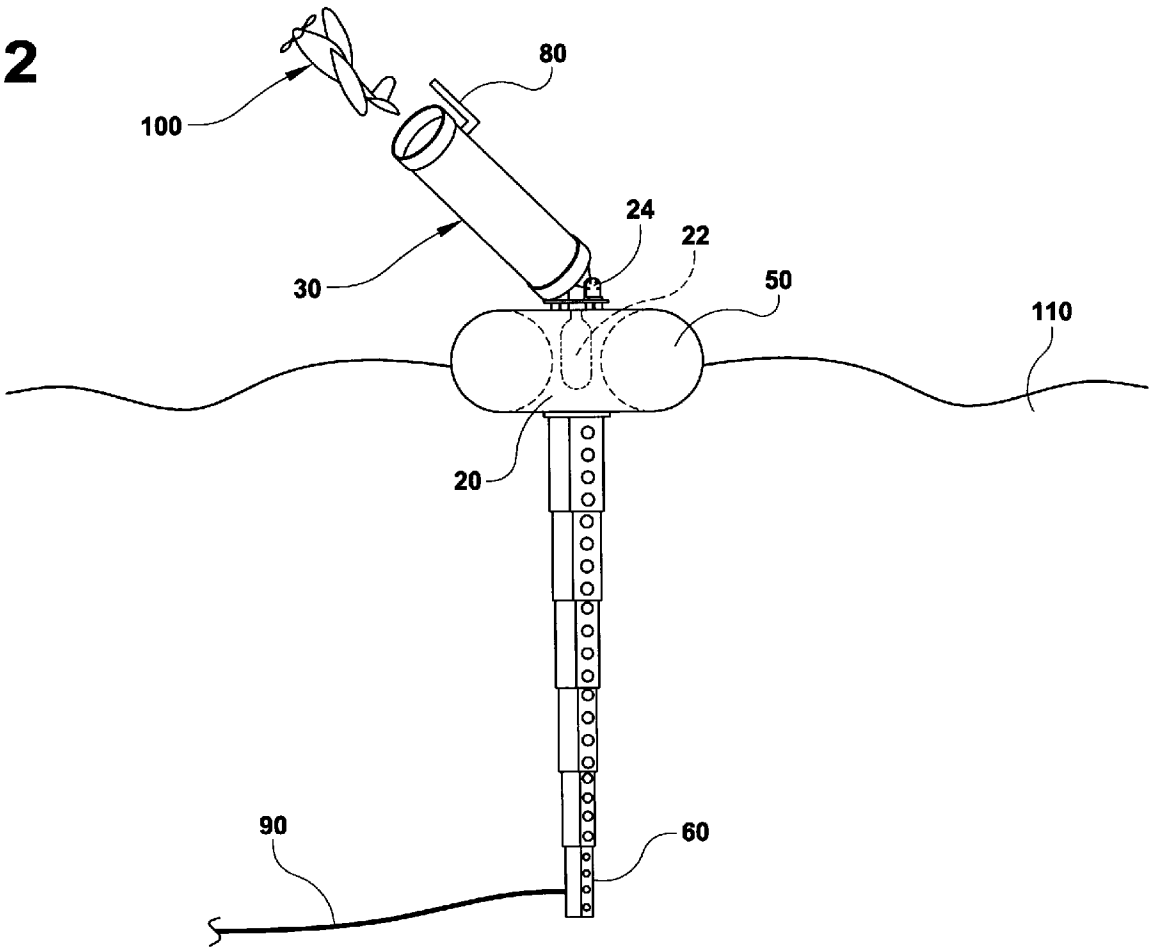
FIG. 2 shows a diagram of an embodiment of a system in accordance with the System and Method for an Underwater Launched Unmanned Aerial Vehicle, deployed in a water environment.

FIG. 2 shows a diagram of system 10 deployed in a water environment 110. As an example, system 10 may be deployed by an underwater vehicle such as a submarine. In such embodiments, system 10 may be contained within a capsule (not shown) and launched from the submarine. After launch, the capsule may break away from system 10 before system 10 ascends to the surface of the water. In other embodiments, system 10 may be deployed by hand by a diver located within a water environment.

When system 10 is deployed, collapsible stabilizing weight 60 is extended and inflatable bladder 50 is inflated. Inflatable bladder 50 may be inflated manually by a diver (in a diver-deployed scenario), or autonomously based upon actions taken by the onboard control circuitry, or based upon a signal received by fiber-optic cable 90 and transmitted to control circuitry (not shown) contained within launch tube 32. Similarly, collapsible stabilizing weight 60 may be either manually or automatically extended depending on the deployment scenario.

Fiber-optic cable 90 extends from the end of collapsible stabilizing weight 60. Fiber-optic cable 90 may extend within collapsible stabilizing weight 60, through support structure 20, to communications circuitry contained within launch tube 32. Support structure 20 may include a compressed air tank 22 stored therein. In some embodiments, system 10 includes a fiber spool (not shown) connected to collapsible stabilizing weight 60 that allows fiber-optic cable 90 to be extended a desired length from system 10. Such embodiments allow for a "base" vehicle to be located at various distances from system 10. Compressed air tank 22 may include various types of compressed air. As an example, compressed air tank may include $CO_2$ stored therein.

Support structure 20 may also include protrusions 24 extending from one end. Protrusions 24 may be coupled to pneumatic launching assembly 30 such that the angle of pneumatic launch assembly 30 with respect to support structure 20 is adjustable. As an example, a pair of protrusions 24 may be connected to a pair of protrusions on one end of pneumatic launching assembly 30 by a pin. In other embodiments, support structure 20 may be hingedly coupled to pneumatic launching assembly 30 to allow for angular adjustment of pneumatic launching assembly 30 with respect to support structure 20. In some embodiments, actuators controlled by control circuitry contained within launch tube 32 may adjust the angle of pneumatic launch assembly 30 with respect to support structure 20. In some embodiments, inflatable bladder 50 is sized and positioned such that pneumatic launch assembly 30 relies on contact with an inflated inflatable bladder 50 to reach the appropriate launch angle.

In embodiments where system 10 is either deployed from an underwater vehicle or by a diver, system 10 may include a fiber spool (not shown) coupled to the distal end of collapsible stabilizing weight 60. The fiber spool may have at least a portion of fiber-optic cable 90 wound thereabout. The fiber spool may be configured to extend fiber-optic cable 90 from collapsible stabilizing weight 60 as system 10 travels further from its deployment location. The other end of fiber-optic cable 90 may be connected to an underwater vehicle to which system 10 communicates.

Figure 3:
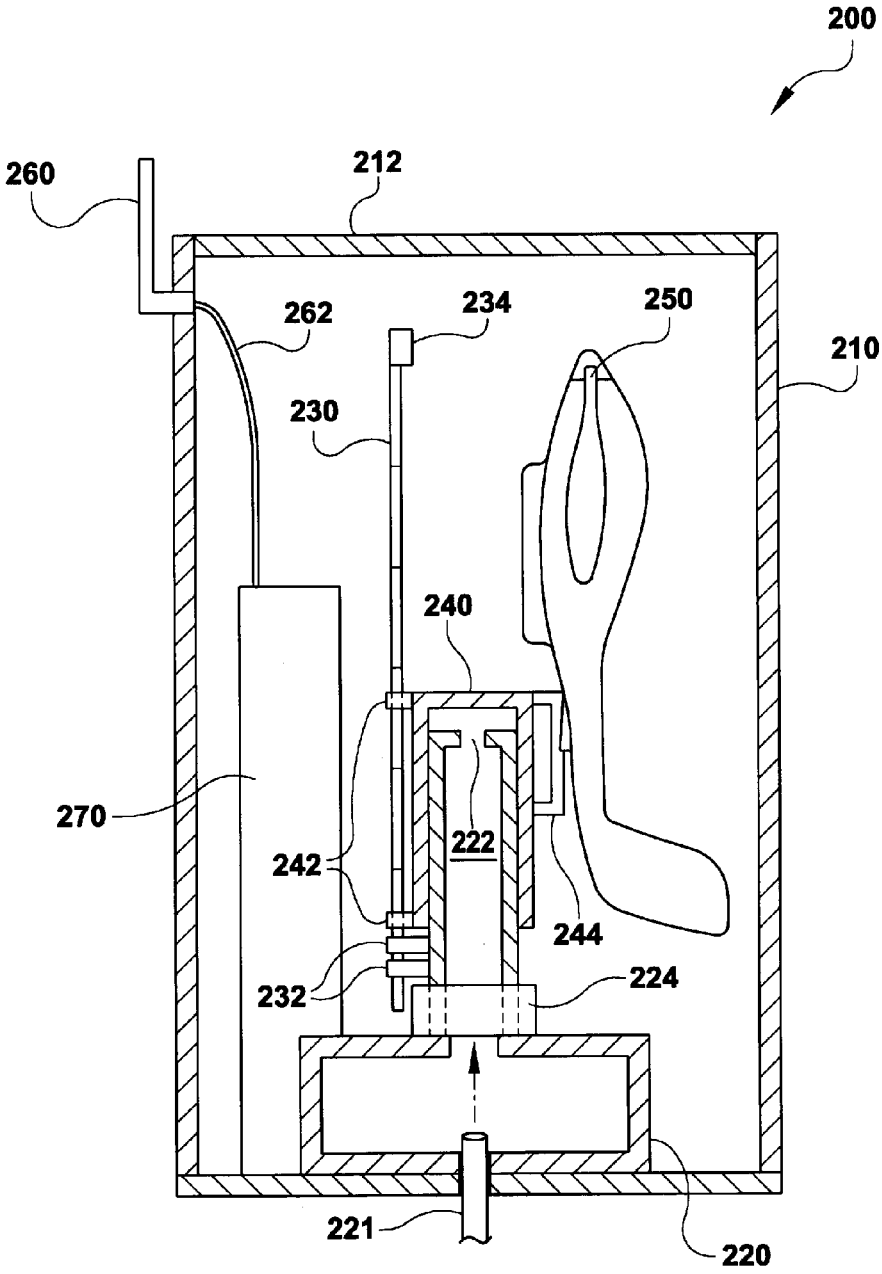
FIG. 3 shows a partial cut-away of the pneumatic launch assembly of an embodiment of a system in accordance with the System and Method for an Underwater Launched Unmanned Aerial Vehicle, with a UAV within the pneumatic launch tube.
Figure 4:
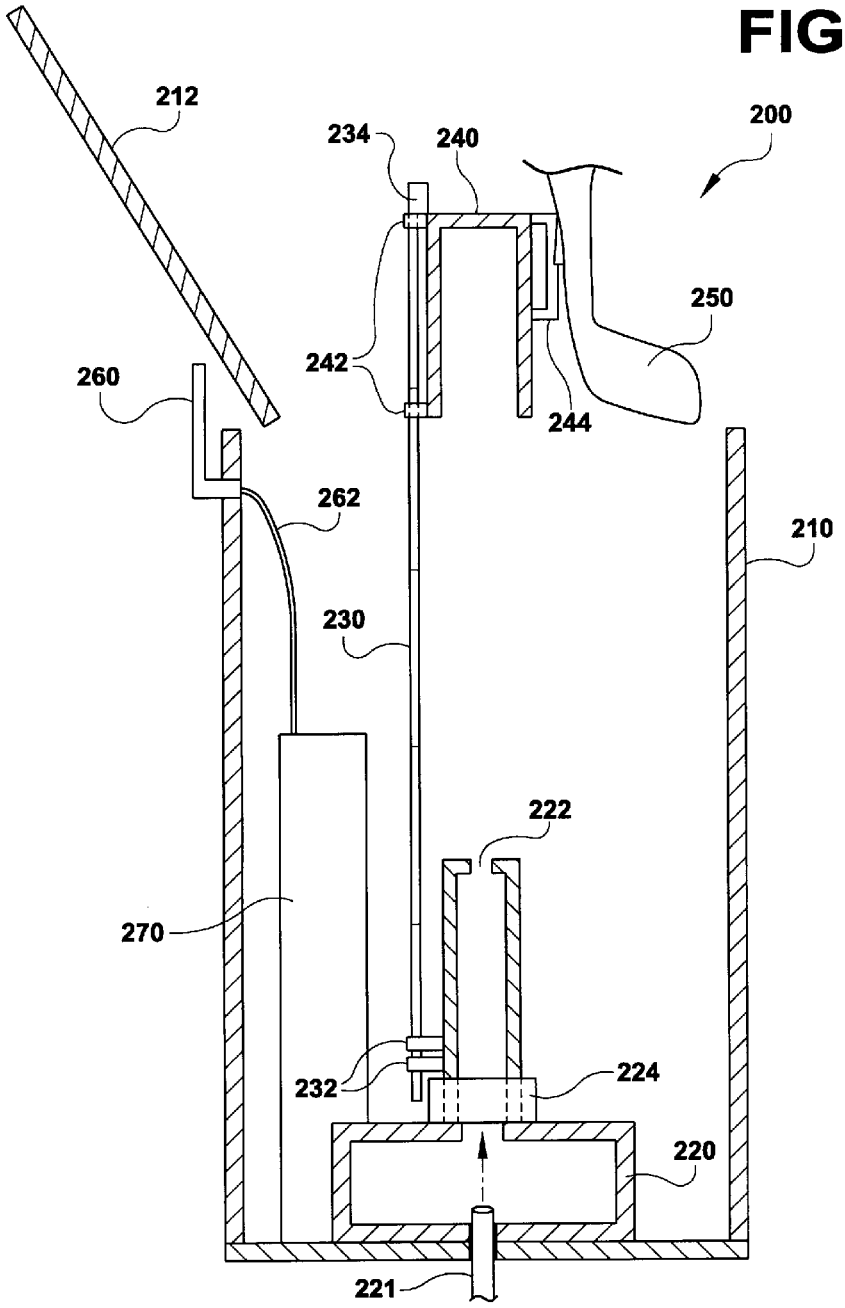
FIG. 4 shows a partial cut-away of the pneumatic launch assembly of an embodiment of a system in accordance with the System and Method for an Underwater Launched Unmanned Aerial Vehicle, with a UAV being launched from the pneumatic launch tube.

Referring to FIGS. 3 and 4, FIG. 3 shows a partial cut-away of the pneumatic launch assembly 200 of an embodiment of a system in accordance with the System and Method for an Underwater Launched Unmanned Aerial Vehicle, wherein a UAV 250 is positioned within a launch tube 210, while FIG. 4 shows the launching of the UAV 250 from launch tube 210. It should be noted that FIGS. 3 and 4 depict launch tube 210 in a vertical orientation for illustration purposes. In an operating environment, launch tube 210 may be oriented at an angle with respect to a support structure, as shown in FIG. 2. As an example, UAV 250 may be a foldable wing UAV, such as the TACMAV and Nighthawk developed by Applied Research Associates, Inc.

Pneumatic launch assembly 200 includes a launch tube 210 having a cap 212 secured at one end. A compressed air manifold 220 may be contained within launch tube 210 and may be in fluid connection with a compressed air tank stored within a support structure. As an example, a tube 221 may be connected between compressed air manifold 220 and the compressed air tank (such as compressed air tank 22 of FIG. 1) to allow compressed air manifold 220 to be in fluid connection with the compressed air tank. Compressed air manifold 220 may have an air outlet 222 that allows air to exit compressed air manifold 220. Pneumatic launch assembly 200 may also include an air valve 224 that controls the flow of air within compressed air manifold 220. Prior to compressed air being released from compressed air manifold 220 through air valve 224, the air within the compressed air tank, tube 221, and compressed air manifold 220 is maintained at a constant pressure.

A telescoping guide rod 230 may be connected to compressed air manifold 220 by guide rod mounts 232. Telescoping guide rod 230 may include a shuttle stopping mechanism 234 at the distal end thereof. A shuttle 240 may be slidably coupled to telescoping guide rod 230 by shuttle mounts 242. Shuttle mounts 242 may be slidably engaged with telescoping guide rod 230 such that shuttle 240 may slide along telescoping guide rod 230. Shuttle 240 may be at least partially disposed over air outlet 222. Telescoping guide rod 230 helps ensure successful UAV transition to flight by providing added stability as the UAV exits the launch tube. Telescoping guide rod 230 should be configured such that its extended height allows for the UAV to fully exit the launch tube before shuttle 240 contacts shuttle stopping mechanism 234. Such a configuration helps ensure a successful transition to flight performance for, in particular, a foldable wing UAV assembly.

Shuttle 240 includes a UAV attachment mechanism 244 for attachment of UAV 250 to shuttle 240. UAV attachment mechanism 244 may be configured in various ways to engage various types of UAVs. For example, UAV attachment mechanism 244 may be configured to engage a hook-shaped member extending from UAV 250 such that, when UAV 250 is within launch tube 210 it remains upright (see FIG. 3), and when UAV 250 is launched from launch tube 210, UAV attachment mechanism 244 allows for a clean disengagement of UAV 250 without imparting any non-axial forces upon UAV 250. As another example, UAV attachment mechanism 244 may include a top portion and two sides, wherein the sides are connected to shuttle 240 and UAV 250 is releasably connected to the top portion. Such a configuration may allow for added stability of UAV 250 during launch.

To launch UAV 250, compressed air flows from a compressed air tank through tube 221, into compressed air manifold 220, and out of air outlet 222, causing an upward force on shuttle 240. Shuttle 240 slides up telescoping guide rod 230 until the top shuttle mount 242 contacts shuttle stopping mechanism 234 (see FIG. 4), stopping the upward motion of shuttle 240. During the movement of shuttle 240 along telescoping guide rod 230, UAV 250 will contact cap 212 and force cap 212 to be disengaged from launch tube 210. In some embodiments, cap 212 is tethered to launch tube 210. In other embodiments, cap 212 is not tethered to launch tube 210. UAV attachment mechanism 244 allows UAV 250 to be disengaged and carried out of launch tube 210 by the upward force exerted on shuttle 240 by the compressed air.

Pneumatic launch assembly 200 may further include an antenna 260, which may be connected to communications and control circuitry 270 contained within launch tube 210 by cable 262. As shown, antenna 260 is connected to launch tube 210. Such connection may occur by various methods as recognized by one having ordinary skill in the art.

Figure 5:
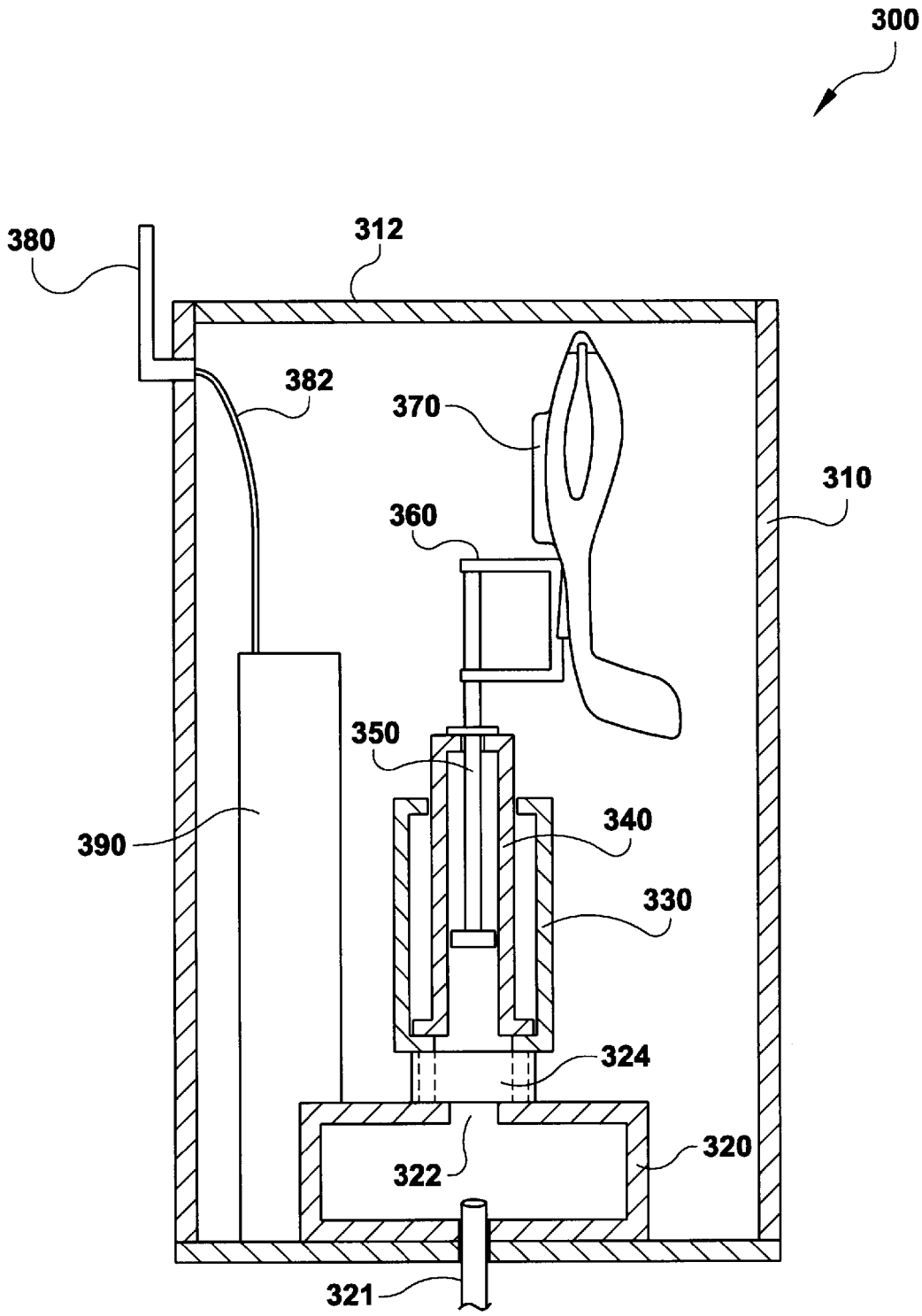
FIG. 5 shows a partial cut-away of the pneumatic launch assembly of an embodiment of a system in accordance with the System and Method for an Underwater Launched Unmanned Aerial Vehicle, with a UAV within the pneumatic launch tube.
Figure 6:
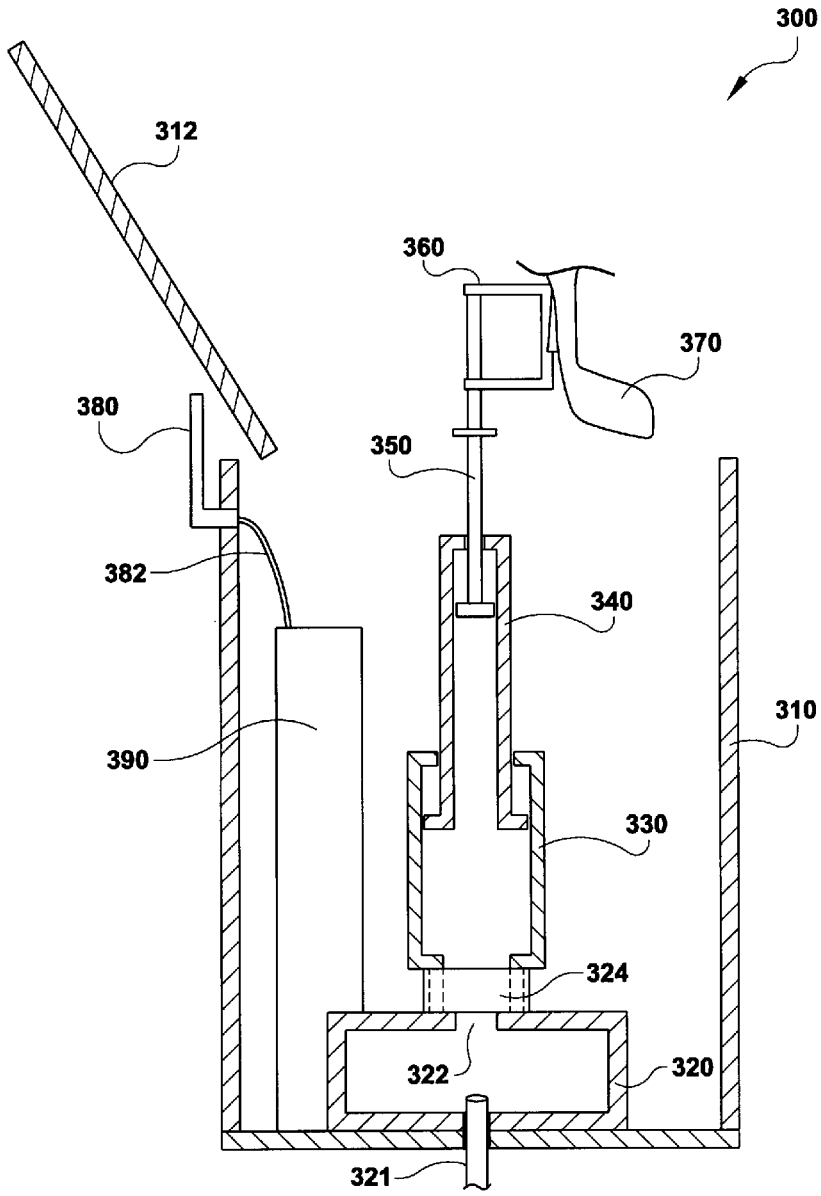
FIG. 6 shows a partial cut-away of the pneumatic launch assembly of an embodiment of a system in accordance with the System and Method for an Underwater Launched Unmanned Aerial Vehicle, with a UAV being launched from the pneumatic launch tube.

Referring to FIGS. 5 and 6, FIG. 5 shows a partial cut-away of the pneumatic launch assembly 300 of an embodiment of a system in accordance with the System and Method for an Underwater Launched Unmanned Aerial Vehicle, wherein a UAV 370 is within a launch tube 310, while FIG. 6 shows the launching of the UAV 370 from launch tube 310. It should be noted that FIGS. 5 and 6 depict launch tube 310 in a vertical orientation for illustration purposes. In an operating environment, launch tube 310 may be configured at an angle with respect to a support structure, as shown in FIG. 2.

Figure 7:
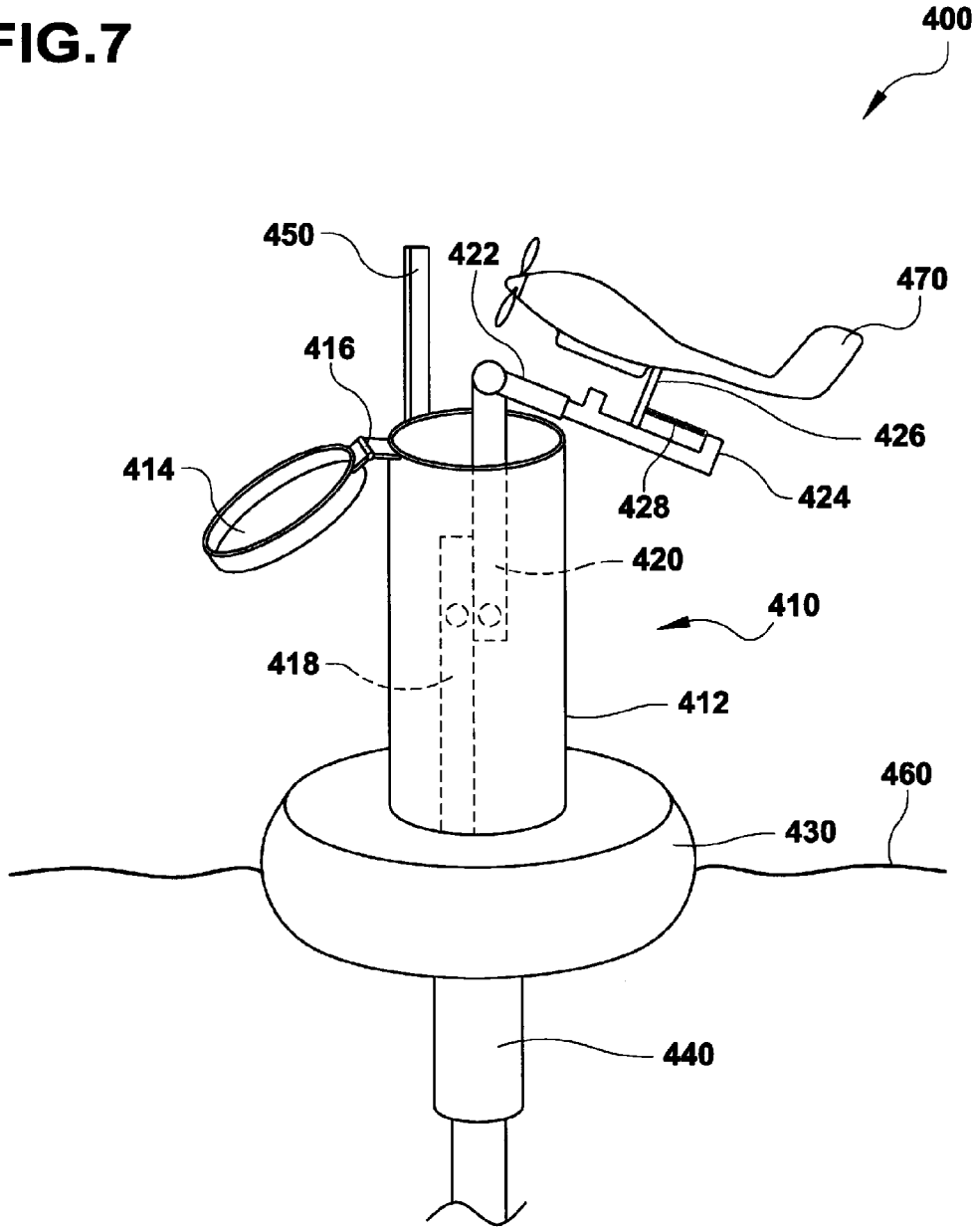
FIG. 7 shows a diagram of an embodiment of a system having a launch track deployed in a water environment, in accordance with the System and Method for an Underwater Launched Unmanned Aerial Vehicle.

Pneumatic launch assembly 300 includes a launch tube 310 having a cap 312 at one end. Cap 312 may be pressure fit within launch tube 310. In other embodiments, cap 312 may be secured to launch tube 310, as shown in FIG. 7. A compressed air manifold 320 may be contained within launch tube 310 and may be in fluid connection with a compressed air tank stored within a support structure. As an example, a tube 321 may be connected between compressed air manifold 320 and the compressed air tank (such as compressed air tank 22 of FIG. 1) to allow compressed air manifold 320 to be in fluid connection with the compressed air tank. Compressed air manifold 320 may have an air outlet 322 that allows air to exit compressed air manifold 320. Pneumatic launch assembly 300 may also include an air valve 324 that controls the flow of air within compressed air manifold 320. Prior to compressed air being released from compressed air manifold 320 through air valve 324, the air within the compressed air tank, tube 321, and compressed air manifold 320 is maintained at a constant pressure.

A piston housing 330 may be coupled to compressed air manifold 320 and disposed over air outlet 322. Pneumatic launch assembly 300 may further include a first piston 340 slidably disposed within piston housing 330, a second piston 350 slidably disposed within first piston 340, and a UAV attachment mechanism 360 coupled to second piston 350. UAV attachment mechanism 360 may be configured in various ways to engage various types of UAVs. For example, UAV attachment mechanism 360 may be configured to engage a hook-shaped member extending from UAV 370 such that, when UAV 370 is within launch tube 310 it remains upright (see FIG. 5), and when UAV 370 is launched from launch tube 310, UAV attachment mechanism 360 allows for a clean disengagement of UAV 370 without imparting any non-linear forces upon UAV 370. As another example, UAV attachment mechanism 360 may include a top portion and two sides, wherein the sides are connected to second piston 350 and UAV 370 is releasably connected to the top portion. Such a configuration may allow for added stability of UAV 370 during launch.

To launch UAV 370, compressed air flows from a compressed air tank though tube 321, into compressed air manifold 320, and out of air outlet 322, causing first piston 340 to extend within piston housing 330 and second piston 350 to extend within first piston 340. During the extension of first piston 340 and second piston 350, UAV 370 will contact cap 312 and force cap 312 to be disengaged from launch tube 310. In some embodiments, cap 312 is tethered to launch tube 310. In other embodiments, cap 312 is not tethered to launch tube 310. After first piston 340 and second piston 350 have been fully extended, UAV attachment mechanism 360 allows for UAV 370 to be disengaged and carried out of launch tube 310 by the upward force exerted by the compressed air.

Pneumatic launch assembly 300 may further include an antenna 380, which may be connected to communications and control circuitry 390 contained within launch tube 310 by cable 382. As shown, antenna 380 is connected to launch tube 310. Such connection may occur by various methods as recognized by one having ordinary skill in the art.

FIG. 7 shows a diagram of an embodiment of a system 400 having a launch track, in accordance with the System and Method for an Underwater Launched Unmanned Aerial Vehicle. As shown, system 400 is deployed in a water environment 460. System 400 may be deployed by an underwater vehicle or may be human deployed. System 400 may include a launching assembly 410, an inflatable bladder 430, a collapsible stabilizing weight 440, and an antenna 450. Launching assembly 410 may include a launch tube 412 having a cap 414 secured thereto by a securing member 416. Securing member 416 may comprise various securing mechanisms as recognized by one having ordinary skill in the art, such as a hinged mechanism or a flexible plastic attachment mechanism.

A launch track may be disposed within launch tube 412. The launch track may include a first track member 418, a second track member 420 coupled on one end to first track member 418 such that second track member 420 is linearly translatable with respect to first track member 418, and a third track member 422 coupled to the other end of second track member 420. Second track member 420 may be linearly translated with respect to first track member 418 via actuators controlled by control circuitry (not shown) located within launch tube 412. Third track member 422 may be coupled to second track member 420 by various means. Third track member 422 may be angularly adjustable with respect to second track member 420. Such adjustment may occur by actuators controlled by control circuitry (not shown) located within launch tube 412.

Prior to launching UAV 470, second track member 420 is translated with respect to first track member 418 such that UAV 470 is out of launch tube 412. Then, third track member 422 is angularly adjusted with respect to second track member 420 such that UAV 470 is positioned at an appropriate launch angle. As an example, third track member 422 may be positioned at any angle within a range of 0 to 90 degrees.

A spring-loaded member 424 may be coupled to third track member 422. A UAV attachment mechanism 426 may be coupled to spring-loaded member 424. UAV attachment mechanism 426 may be configured in various ways to engage various types of UAVs 470. Spring-loaded member 424 may be pre-loaded with a UAV 470 such that when a control signal is received by system 400, the tension on a spring 428 within spring-loaded member 424 is released, exerting a lateral force on UAV attachment mechanism 426 and causing UAV 470 to be propelled from launching assembly 410 at an angled orientation.

Many modifications and variations of the System for Water-based Launch of an Unmanned Aerial Vehicle are possible in light of the above description. Within the scope of the appended claims, the System for Water-based Launch of an Unmanned Aerial Vehicle may be practiced otherwise than as specifically described. Further, the scope of the claims is not limited to the implementations and embodiments disclosed herein, but extends to other implementations and embodiments as may be contemplated by those having ordinary skill in the art.

We claim:

1. A system comprising:

a support structure having at least one compressed air tank stored therein;

a pneumatic launch assembly coupled to one end of the support structure, wherein the angle of the pneumatic launch assembly with respect to the support structure is adjustable, the pneumatic launch assembly comprising a launch tube, a compressed air manifold contained within the launch tube and in fluid connection with the compressed air tank, the compressed air manifold having an air outlet, a telescoping guide rod connected to the compressed air manifold, and a shuttle coupled to and slidable along the telescoping guide rod and at least partially disposed over the air outlet, the shuttle having an unmanned aerial vehicle attachment mechanism; and an inflatable bladder disposed around at least a portion of a region defined by the support structure and the pneumatic launch assembly.

2. The system of claim 1 further comprising a collapsible stabilizing weight coupled to the other end of the support structure.

3. The system of claim 2 further comprising communications circuitry and control circuitry contained within the launch tube.

4. The system of claim 3, wherein the angle of the pneumatic launch assembly with respect to the support structure is adjusted by the control circuitry.

5. The system of claim 3 further comprising a fiber-optic cable connected to the communications circuitry, the fiber-optic cable extending through the collapsible stabilizing weight.

6. The system of claim 5 further comprising an antenna connected to the communications circuitry.

7. The system of claim 6, wherein the antenna is coupled to the launch tube.

8. The system of claim 1, wherein the inflatable bladder is disposed around at least a portion of the support structure.

9. The system of claim 1, wherein the inflatable bladder is disposed around at least a portion of the launch tube.

10. The system of claim 1, wherein the telescoping guide rod has a shuttle stopping mechanism coupled to one end.

11. The system of claim 1, wherein the pneumatic launch assembly further comprises a cap coupled to the distal end of the launch tube.

12. The system of claim 1, wherein the compressed air manifold is in fluid connection with the compressed air tank via a tube connected between the compressed air manifold and the compressed air tank.

* * * * *